US006820326B1

(12) United States Patent
Tarpill et al.

(10) Patent No.: US 6,820,326 B1
(45) Date of Patent: Nov. 23, 2004

(54) COMPRESSION ASSEMBLY TOOL WITH MULTIPLE SPLIT BASES

(75) Inventors: Andrew J. Tarpill, East Haddam, CT (US); Tadeusz Zagula, Hartford, CT (US)

(73) Assignee: Capewell Components Company, LLC, Cronwell, CT (US)

( * ) Notice: Subject to any disclaimer, the term of this patent is extended or adjusted under 35 U.S.C. 154(b) by 22 days.

(21) Appl. No.: 10/264,827

(22) Filed: Oct. 5, 2002

(51) Int. Cl.[7] ..... H01R 43/042

(52) U.S. Cl. ..... 29/751; 29/750; 29/753; 29/758; 29/761; 72/409.14; 72/409.1; 81/313; 7/107

(58) Field of Search ..... 29/758, 751, 753, 29/750, 761, 760, 763, 268, 282; 72/409.01, 409.14; 81/313, 314; 7/107

(56) References Cited

U.S. PATENT DOCUMENTS

| | | | |
|---|---|---|---|
| 172,365 | A | 1/1876 | Adams et al. |
| 443,312 | A | 12/1890 | Bode |
| 552,400 | A | 12/1895 | Spires |
| 1,813,971 | A | 7/1931 | Taylor |
| 1,879,058 | A | 9/1932 | Brockman |
| 1,904,903 | A | 4/1933 | Sweet |
| 2,202,894 | A | 6/1940 | Bihler |
| 2,333,120 | A | 11/1943 | Parker |
| 2,852,841 | A | 9/1958 | Ballard et al. |
| 3,094,774 | A | 6/1963 | Nazarow et al. |
| 3,226,968 | A | 1/1966 | Holmes |
| 3,757,408 | A | 9/1973 | Shemtov |
| 3,793,693 | A | 2/1974 | Levak |
| 4,136,549 | A | 1/1979 | Lytle et al. |
| 4,345,361 | A | 8/1982 | Baumann |

(List continued on next page.)

FOREIGN PATENT DOCUMENTS

| | | |
|---|---|---|
| DE | 24 29 280 | 6/1974 |
| GB | 2 081 629 A | 2/1982 |

OTHER PUBLICATIONS

Augat Communications Division LRC Product, Installation & Product Data Handbook; LRC Electronics, Inc. Box 111, Horseheads, NY 14845,6/92,5M; pp. 1–123 plus cover page, Jun. 1992.

New Product Release—PT–5000 Pocket Terminx®, The Cutting Edge, Cable Prep Cable TecExpo Edition Issue 5, Spring 1997.

Compression Tool, Broadband System & Design, a Gordon Publication, Apr. 1997, vol. 3, No. 3.

Compression Tool, Communications Technology, A CT Publications Product, Sep. 1996.

Terminx®, The Next Generation In Cable Termination Tools, Cable Prep.

*Primary Examiner*—Minh Trinh
(74) *Attorney, Agent, or Firm*—DeLio & Peterson, LLC

(57) ABSTRACT

A compression assembly tool having multiple split bases for attaching connectors of different sizes to corresponding coaxial cables of different dimensions by compressing the connectors axially. The tool uses a light rigid O-frame and at least two pairs of split base supports located at different distances from a compression plunger driven by a lever handle. The handle is spring-loaded to the open position, but is held in the closed position by a wire bail for storage. The pairs of split base supports have annular bearing surfaces of different diameters that support the back of different connectors over a full 360 degrees. The split base supports are pivotally attached to the body, are held closed by a spring and are easily opened by squeezing push surfaces located on the split base supports towards each other to pivot the split base supports to the open position. The split base supports have stops to bring them positively into correct alignment with the axis of compression when the split base supports are released and return to the closed position.

19 Claims, 3 Drawing Sheets

U.S. PATENT DOCUMENTS 4,483,056 A 11/1984 Schwalm et al.
4,509,244 A 4/1985 Houck et al.
4,559,691 A 12/1985 Mannhart et al.
4,589,271 A 5/1986 Laux
4,691,905 A 9/1987 Tamura et al.
4,794,780 A 1/1989 Battenfeld
4,932,091 A 6/1990 Krzyzanski
5,040,288 A 8/1991 Nilsson
5,105,648 A 4/1992 Steiner et al.
5,113,474 A 5/1992 Slaney et al.
5,138,864 A 8/1992 Tarpill
5,392,508 A 2/1995 Holliday et al.
5,435,167 A 7/1995 Holliday et al.
5,596,800 A 1/1997 Holliday et al.
5,647,119 A 7/1997 Bourbeau et al.
5,934,137 A 8/1999 Tarpill
6,101,862 A * 8/2000 Rzasa et al. ..... 72/413

* cited by examiner

COMPRESSION ASSEMBLY TOOL WITH MULTIPLE SPLIT BASES

BACKGROUND OF THE INVENTION

1. Field of the Invention

This invention relates to tools for attaching connectors to coaxial cables by compressing the connector in a direction parallel to the axis of the cable. More specifically, the present invention relates to axial compression tools capable of attaching different sizes of axial compression connectors to cable of correspondingly different diameters.

2. Description of Related Art

Coaxial cable is widely used to carry radio and television signals, digital data and the like. A major user of coaxial cable is the cable television industry, which uses coaxial cable to carry the signal from a central location to each subscriber.

To make the many connections required for the cable television network requires the installation of numerous coaxial cable connectors. To avoid any interruption in service, it is critical that the connectors be applied properly. Many problems with poor signal quality that require expensive service calls are the result of a connector that was initially installed incorrectly.

Coaxial cable connectors come in a variety of designs, and are attached in a correspondingly wide variety of ways with various tools. However, an increasingly popular connector design is secured to the prepared end of the coaxial cable by axially compressing the connector, i.e. by compressing the connector in a direction that is parallel to the longitudinal axis of the coaxial cable.

Connectors that are applied this way are available for different cable diameters and have heretofore required different tools for compressing them. U.S. Pat. No. 5,934,137 owned by the assignee of this application shows a widely used axial compression assembly tool, capable of rapid and reliable operation. However, that tool, like other competing designs, is intended to handle only a single connector size. Typically, an installer will carry one tool for attaching connectors to large diameter cable of the type used to distribute the signal from a central point to a neighborhood, and a second tool for attaching smaller connectors on smaller diameter cable used at each drop point to bring the signal into the subscriber's home.

The present tool addresses the industry desire to reduce the number of cable installation tools that the installer must carry.

Bearing in mind the problems and deficiencies of the prior art, it is therefore an object of the present invention to provide a compression assembly tool for axially compressing at least two different sizes of electrical connectors onto coaxial cables.

It is another object of the present invention to provide a compression assembly tool which allows the cable and compressed connector to be easily removed from the tool after the connector is compressed.

A further object of the invention is to provide a compression tool which maintains the axis of the coaxial cable in accurate alignment with the axis of the plunger.

It is yet another object of the present invention to provide a compression tool which is easy to use and which opens automatically, but which can be stored in the closed position.

A further object of the present invention is to provide a compression tool which can be easily adjusted.

SUMMARY OF THE INVENTION

The above and other objects and advantages, which will be apparent to those skilled in the art, are achieved in the present invention which is directed to, in a first aspect, a compression assembly tool for attaching first and second connectors of different sizes to the ends of corresponding first and second different cables. The compression assembly tool includes a body having an open portion defining a compression region for receiving the connectors when they are being attached to their corresponding cables.

A lever handle is pivotally attached to the body and drives a plunger in a longitudinal sliding motion relative to the body between an extended position and a retracted position. In the extended position the plunger axially compresses a connector placed into the compression region. In the retracted position the plunger moves out of the way and the compressed connector can be removed from the compression region.

The tool has at least two pairs of split base supports located at different distances from the plunger to accommodate different connectors. A first pair of split base supports is located a first distance from the plunger when the plunger is in the extended position. The first split base supports pivot on the body between an open position and a closed position and each of the first split base supports has an annular bearing surface of a first diameter corresponding to the diameter of the first cable.

A second pair of split base supports is located a second distance from the plunger when the plunger is in the extended position. The second distance is greater than the first distance to accommodate the length of the second longer connector. The second split base supports are also pivotally attached to the body for motion between an open position and a closed position. Each of the second split base supports has an annular bearing surface of a second diameter corresponding to the second cable. The first split base supports open sufficiently to move out of the way and accommodate the diameter of the second connector when the larger second connector is being compressed.

First and second springs operate to urge the first and second split base supports towards the closed position. The annular bearing surfaces of the first split base supports encircle the first cable when they are closed. In the closed position the first pair of split base supports provide annular bearing support for the end of the first connector opposite the plunger during compression. The annular bearing surfaces of the first split base supports allow the first cable to be removed when the first split base supports are in the open position. The annular bearing surfaces of the second split base supports operate in the same way to encircle the second cable when the second split base supports are in the closed position and provide annular bearing support for the back end of the second connector.

In another aspect of the compression assembly tool, at least one of the first split base supports and at least one of the second split base supports include a stop surface that contacts the body as the split base supports close. This brings the first and second split base supports into axial alignment with the plunger when the split base supports are closed. In the preferred design, all of the split base supports are identical, except for the diameter of the annular bearing surfaces, and all include a stop surface of this type.

The plunger is preferably driven by a link and includes a removable plunger tip that is threaded into the plunger. This allows the plunger tip to be longitudinally adjusted by rotating it relative to the plunger to adjust the distance between the plunger and the split bases and thereby adjust the amount by which the connectors are compressed. When a threaded adjustable plunger tip is used, a locking screw is provided to lock the plunger tip against rotation. The locking screw threads transversely into an end of the plunger to lock the plunger tip against rotation.

In yet another aspect of the invention, the compression assembly tool uses an O-frame to provide a light, but strong body structure. In still another aspect of the invention both of the pairs of first and second split base supports are pivotally attached to the body via a common pivot. The handle is provided with a handle spring mounted between the body and the lever handle for urging the lever handle away from the body. A releasable handle lock holds the lever handle towards the body when the tool is not in use.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENTS

In describing the preferred embodiment of the present invention, reference will be made herein to FIGS. 1–4 of the drawings in which like numerals refer to like features of the invention.

Figure 1:
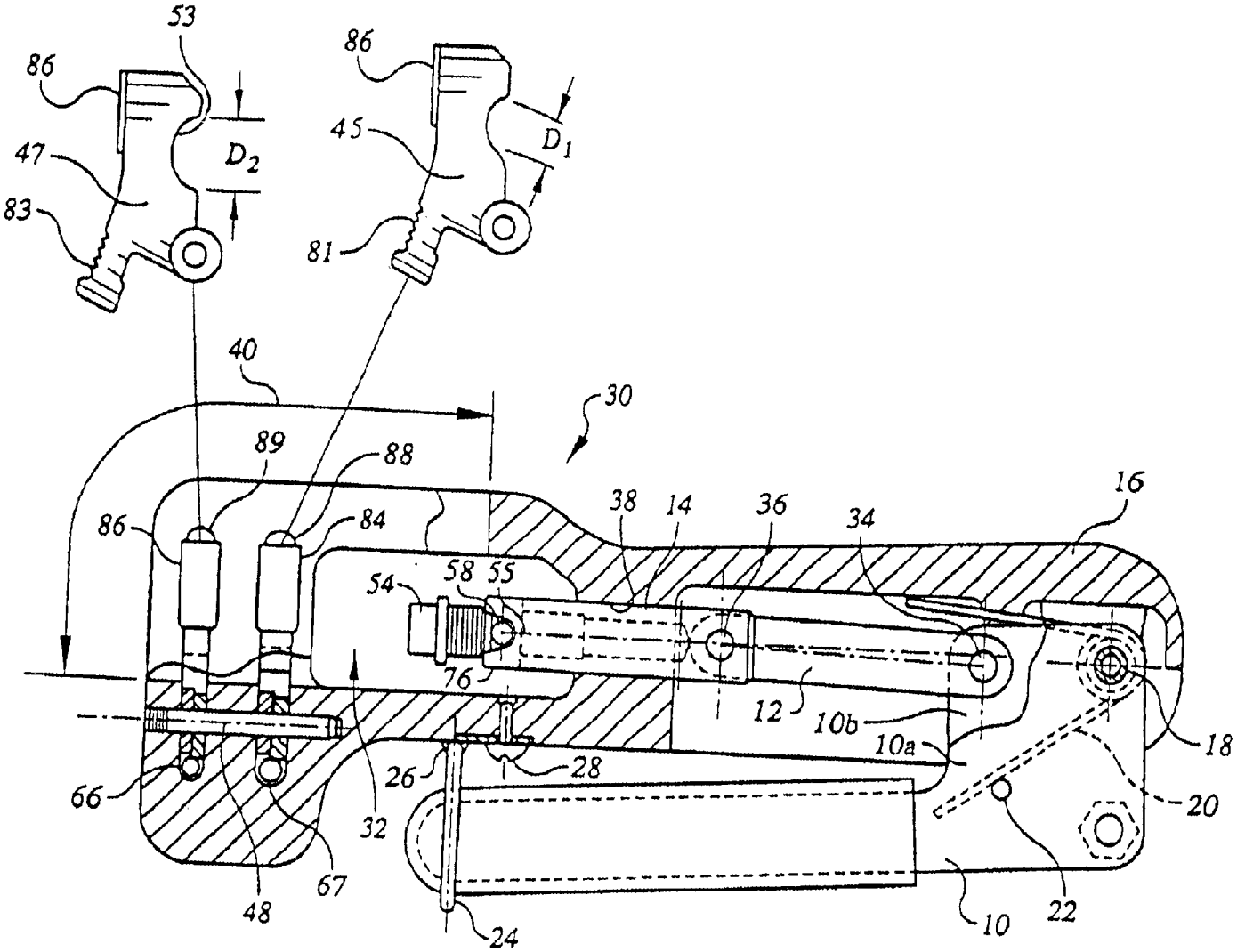
FIG. 1 is a side elevational view of the compression assembly tool of the present invention, partly shown in section. Two of the four split bases have been pulled out and rotated to appear in front elevational view, and leader lines have been added to indicate where the two split bases are normally installed.

Referring to FIG. 1, the compression assembly tool of the present invention comprises a lever handle 10 connected to a link 12 driving a plunger 14. The lever handle 10 is formed as a pair of side plates 10*a* and 10*b* with the link 12 pivoting partially therebetween. The lever handle 10 is pivotally attached to a body 16 via pivot 18. A torsion spring 20 acts between the body 16 and a pin 22 extending between the side plates 10*a*, 10*b* to urge the lever handle away from the body 16 when it is not restrained.

FIG. 1 shows the handle being held close to the body with the plunger 14 in the extended position. It is retained in this position by means of a releasable handle lock formed by bail wire 24. The bail wire 24 is mounted to the body via retainer 26 and screw 28 which allow it to rotate and unlatch the handle to pivot away from the body.

The tool body 16 includes an O-frame portion generally indicated with reference no. 30 which defines a compression region 32. As the handle 10 pivots around pivot 18 away from the body, link 12 pivots on pivots 34 and 36 and draws the plunger 14 to the retracted position (toward the right in FIG. 1). As the handle closes, link 12 drives the plunger 14 to the extended position (toward the left in FIG. 1) and compresses a connector located in the compression region.

Figure 4:
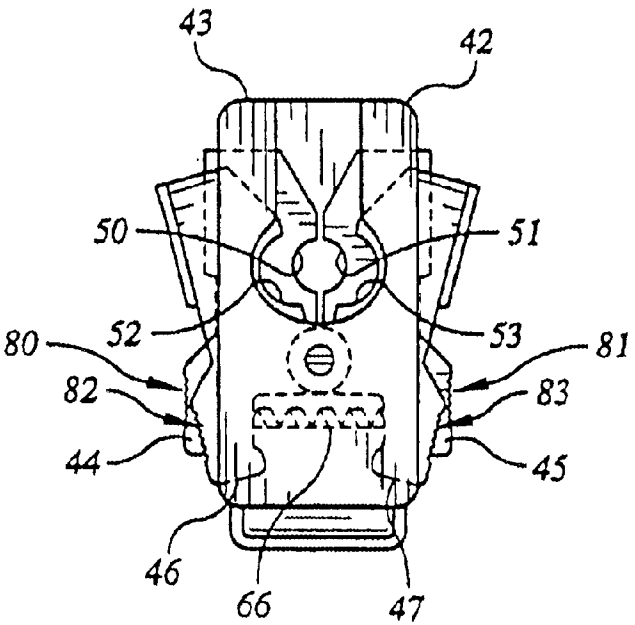
FIG. 4 is a front elevational view of the compression assembly tool of the invention showing the inner first pair of split bases in the closed position and the outer second pair of split bases in the open position.
Figure 3:
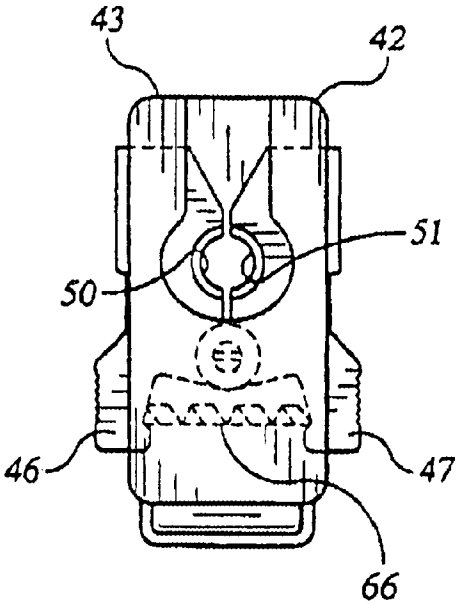
FIG. 3 is a front elevational view of the compression assembly tool of the invention showing all the split bases in the closed position.

The O-frame portion 30 of the body 16 is substantially solid along the right side. A bore 38 extends through this solid portion, and plunger 14 slides within this bore. The bore 38 maintains the plunger in constant axial alignment as it moves between the extended and retracted positions. The body is also solid on the lower half of the O-frame in the vicinity of bail retaining member 26 and screw 28. However, as can be seen in FIGS. 3 and 4, the O-frame is divided into two opposed sidewalls 42, 43 and is open along the entire left upper quadrant indicated with reference no. 40. This allows the coaxial cable and connector to be inserted into the compression region 32 between the sidewalls 42, 43.

With the lever handle 10 moved away from the body, and the plunger 14 in the retracted position, a cable and connector can be placed into the compression region 32 by inserting it between opposed sidewalls 42, 43. The tool is adapted to accept two different sizes of connectors. A smaller connector is attached to a smaller diameter cable by compressing the connector axially against a first split base formed by a pair of split base supports 44, 45. The first pair of split base supports 44, 45 surround the smaller diameter cable and support the back end of the smaller connector against the axial compression force. A larger connector can be attached to a larger diameter cable by compressing the connector axially against a second split base formed by a second pair of split base supports 46, 47 located farther from the plunger 14 than the first split base.

All of the split base supports pivot around pivot 48 between open and closed positions. FIG. 3 shows both pairs of split base supports in the closed position. FIG. 4 shows the first pair of split base supports 44, 45 in the closed position and the second pair of split base supports 46, 47 in the open position.

The first pair of split base supports 44 and 45 are identical to each other and need not be made in different right and left versions. The second split base supports 46 and 47 are also identical to each other. As can be seen in the pullout views of the first and second split base supports 45 and 47 in FIG. 1, the first and second split base supports differ from each other only by the diameter of the annular bearing portions 51 and 53.

In order to compress the smaller connector, the smaller connector is first positioned on the end of the smaller cable. The smaller connector is then placed into the compression region 32. Both the first and second split bases swing open as the cable is pushed between the pairs of split base supports. The split base supports then close to encircle the smaller diameter cable.

Annular bearing portions 50, 51 are located on the inner perimeter of the first pair of split base supports 44, 45. Annular bearing portions 52, 53 are located on the inner perimeter of the second pair of split base supports 46, 47. The diameter $D_1$ of the opening formed by the bearing portions 50, 51 when the first pair of split base supports 44, 45 are in the closed position is sufficiently large to accept the smaller diameter coaxial cable, but is smaller than the diameter of the back end of the smaller connector to be compressed.

The diameter of the opening D2 formed by the bearing portions 52, 53 when the second pair of split base supports 46, 47 are in the closed position is sufficiently large to accept the larger diameter coaxial cable, but is smaller than the diameter of the back end of the larger connector to be compressed. When the larger diameter connector is to be compressed, the first pair of split base supports 44, 45 swing to the open position, and that position provides sufficient clearance for the larger connector to be placed into position in coaxial alignment with the plunger 14.

As the handle is squeezed toward the body, the plunger 14 moves axially towards the first and second split bases. When the smaller connector is in position it is supported at the back end by the first pair of split base supports and this axial motion of the plunger compresses the smaller connector. When the larger connector is in position it is supported at the back end by the second pair of split base supports and this axial motion of the plunger compresses the larger connector. The second split base plays no part when a smaller connector is being compressed and the first split base plays no part when a larger connector is being compressed.

The split base supports 44–47 are supported by the O-frame and particularly by the sidewalls 42, 43. The thickness of the solid lower portion of the O-frame in the vicinity of element 26, can be reduced as compared to prior art devices which do not include the O-frame design and which do not include the sidewalls 42, 43 which stiffen the O-frame against any distortion during the compression cycle. This allows the weight of the tool to be reduced without compromising rigidity and also allows a reduction in material cost.

To ensure that the distance between the plunger 14 and the plane defined by the split bases is correct, the plunger 14 is provided with an adjustable plunger tip 54 which is threadedly engaged via threads 56 into the end of plunger 14. A locking screw 58 allows the plunger tip 54 to be locked into position. A locking pad formed of a resilient material, such as plastic, is positioned in the threaded bore between the tip of the locking screw and the threads 56 of plunger tip 54. The locking pad allows locking screw 58 to exert sufficient force against threads 56 to prevent them from turning while also protecting them from damage.

Figure 2:
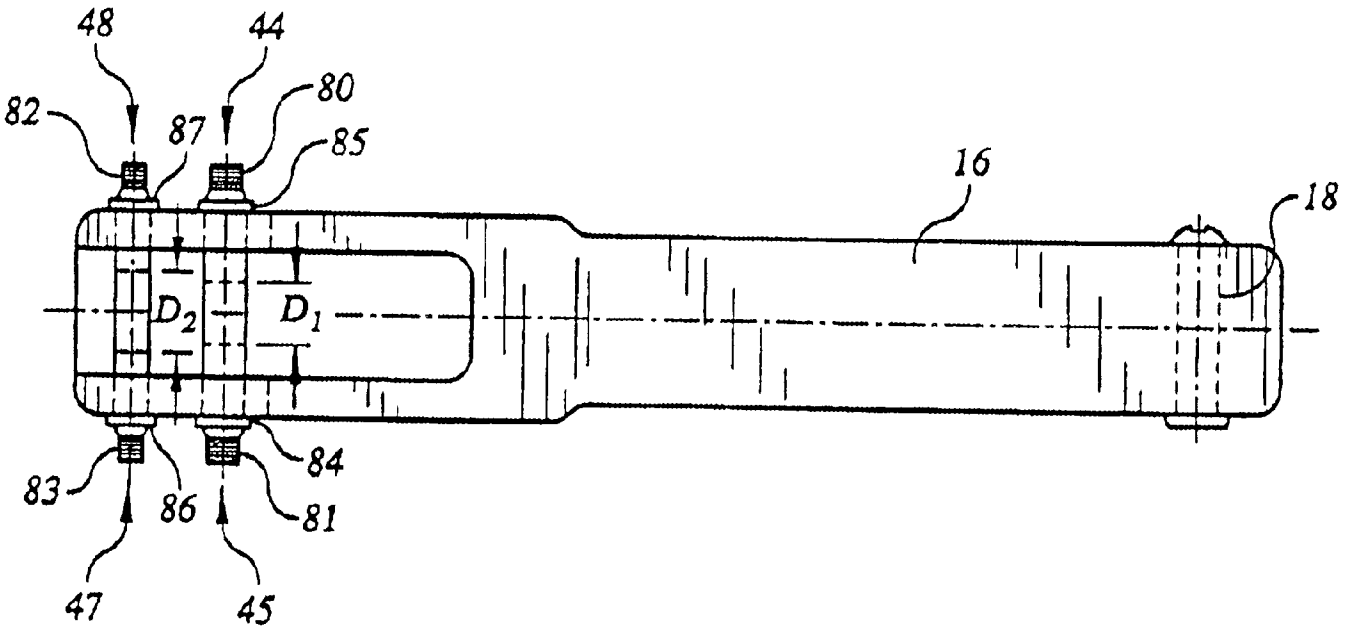
FIG. 2 is a top plan view of the compression assembly tool in FIG. 1.

The locking screw 58 is preferably an Allen screw adjustable by an Allen wrench, and plunger tip 54 is preferably adjustable by inserting an Allen wrench along its axis into the head of the plunger tip. The plunger tip can then be rotated to adjust its position relative to the plunger 14. The hexagonal opening for the Allen wrench also acts to receive the center conductor of a coaxial cable during the compression operation. The plunger tip 54 may be completely unthreaded and removed or replaced. FIG. 2 shows the tool from above with the plunger tip removed.

A gage block may be used to set the distance between the plunger tip 54 and the plane of the first split base. The distance between the plane of the first split base and the second split base is set by the design of the tool and need not be adjusted. Accordingly, a single adjustment for wear automatically makes the necessary adjustment for all sizes of connectors to be compressed by the tool.

The locking screw 58 is threaded into an enlarged end 76 in plunger 14. This enlarged end provides material for the threads holding locking screw 58, and also acts to prevent the plunger 14 from moving too far to the right in the retracted position. In some prior art devices lacking this feature, the handles can be inadvertently locked open when they are opened too far, causing the link between the handles and the plunger to move over center. Such over center locking cannot occur in this design.

The first split base supports 44, 45 include corresponding push surfaces 80, 81. When the push surfaces are squeezed together towards the sidewalls of the body, a spring 67 (see FIG. 1), located between the split base supports is compressed and the first split base supports 44, 45 pivot from the closed position to the open position. The second split base supports 46, 47 include corresponding push surfaces 82, 83. These operate in the same way to compress spring 66 and open the second pair of split base supports 46, 47 so that a cable can easily be inserted.

The convenience of this system of split bases allows springs 66 and 67 to be relatively strong, which is advantageous in securely holding the cable and the attached connector in the correct aligned position.

Another feature provided by the split base supports is positive alignment of the axis of the opening formed by bearing surfaces 50, 51 and 52, 53 with the centerline of the plunger 14. As can be seen best in FIG. 2, The first pair of split base supports 44, 45 include corresponding stop surfaces 84, 85 at their upper ends. The stop surfaces 84, 85 are wider than the slot 88 within which the split base supports pivot. The second pair of split base supports 46, 47 also have stop surfaces 86, 87 at their upper ends that are wider than the slot 88 within which the second pair of split base supports pivot.

In the preferred design, the stop surfaces 84–87 prevent the split base supports from pivoting into slots 88, 89. Springs 66, 67 can be relatively strong and the dimensions of the split base supports are such that stop surfaces 84–87 are flush with the outer sides of the O-frame (as shown in FIGS. 2 and 3) just as the split base supports reach the closed position. This design allows the split base supports to exactly self-enter the cable and connector and accurately position the back end of the connector to be compressed.

Push surfaces 80–83 provide a simple press-to-open design that may be operated with a single hand. The push surfaces 81, 83 are close enough that the thumb may be used to simultaneously press down on both push surfaces. The opposing finger can simultaneously operate push surfaces 80, 82 to fully open both the first and second split bases.

The preferred design shows two pairs of split bases that define support planes at two different distances from the plunger. However, three or even more pairs of split bases may be installed in other embodiments of the invention to accommodate a series of progressively longer connectors.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A compression assembly tool for attaching first and second connectors of different sizes to the ends of corresponding first and second different cables, the compression assembly tool comprising:

a body having an open portion defining a compression region for receiving the end of the first cable and the first connector when the first connector is being attached and for receiving the end of the second cable and the second connector when the second connector is being attached;

a lever handle pivotally attached to the body;

a plunger mounted for longitudinal sliding motion relative to the body, the plunger being driven by the lever handle between an extended position to axially compress the connectors and a retracted position to allow the connectors to be removed from the compression region;

a first pair of split base supports located a first distance from the plunger when the plunger is in the extended position, the first split base supports being pivotally attached to the body for motion between an open position and a closed position, each of the first split base supports having an annular bearing surface of a first diameter corresponding to the first cable;

a second pair of split base supports located a second distance from the plunger when the plunger is in the extended position, the second distance being greater than the first distance, the second split base supports being pivotally attached to the body for motion between an open position and a closed position, each of the second split base supports having an annular bearing surface of a second diameter corresponding to the second cable;

a first spring for urging the first split base supports towards the closed position; and a second spring for urging the second split base supports towards the closed position;

the annular bearing surfaces of the first split base supports encircling the first cable in the closed position and providing annular bearing support for an end of the first connector opposite the plunger during compression, the annular bearing surfaces of the first split base supports allowing removal of the first cable when the first split base supports are in the open position; and the annular bearing surfaces of the second split base supports encircling the second cable in the closed position and providing annular bearing support for an end of the second connector opposite the plunger during compression, the annular bearing surfaces of the second split base supports allowing removal of the second cable and insertion of the first cable and first connector when the second split base supports are in the open position.

2. The compression assembly tool according to claim 1 wherein:

at least one of the first split base supports includes a stop surface for contacting the body and bringing the first split base supports into axial alignment with the plunger when the first split base supports are in the closed position; and at least one of the second split base supports includes a stop surface for contacting the body and bringing the second split base supports into axial alignment with the plunger when the second split base supports are in the closed position.

3. The compression assembly tool according to claim 1 wherein the plunger includes a plunger tip having threads engaged in the plunger, the plunger tip being longitudinally adjustable by rotation relative to the plunger.

4. The compression assembly tool according to claim 3 wherein the plunger includes a locking screw for locking the plunger tip, the locking screw being threadedly engaged into the plunger transversely to the plunger tip.

5. The compression assembly tool according to claim 1 wherein the body comprises an O-frame.

6. The compression assembly tool according to claim 1 wherein:

the body includes a pair of opposed side surfaces;

the first and second split base supports include push surfaces extending outward from the opposed side surfaces of the body when the split base supports are in the closed position; and the first and second split base supports pivot to the open position when the push surfaces are urged towards the side surfaces of the body.

7. The compression assembly tool according to claim 1 wherein the first and second split base supports are pivotally attached to the body via a common pivot.

8. The compression assembly tool according to claim 1 further including:

a handle spring mounted between the body and the lever handle for urging the lever handle away from the body; and a releasable handle lock for holding the lever handle towards the body when the tool is not in use.

9. The compression assembly tool according to claim 8 wherein the releasable handle lock is a wire bail.

10. The compression assembly tool according to claim 1 further comprising a link connected between the lever handle and the plunger, the link having a first end pivotally connected to the lever handle and a second end pivotally connected to the plunger.

11. The compression assembly tool according to claim 1 wherein the plunger includes an enlarged plunger head for restricting retracted motion of the plunger.

12. A compression assembly tool for attaching first and second connectors of different sizes to the ends of corresponding first and second different cables, the compression assembly tool comprising:

a body having a pair of opposed side surfaces and an open portion defining a compression region for receiving the end of the first cable and the first connector when the first connector is being attached and for receiving the end of the second cable and the second connector when the second connector is being attached;

a lever handle pivotally attached to the body;

a plunger mounted for longitudinal sliding motion relative to the body, the plunger being driven by the lever handle between an extended position to axially compress the connectors and a retracted position to allow the connectors to be removed from the compression region;

a first pair of split base supports located a first distance from the plunger when the plunger is in the extended position, the first split base supports being pivotally attached to the body for motion between an open position and a closed position, each of the first split base supports having an annular bearing surface of a first diameter corresponding to the first cable and a push surface extending outward from one of the side surfaces of the body;

a second pair of split base supports located a second distance from the plunger when the plunger is in the extended position, the second distance being greater than the first distance, the second split base supports being pivotally attached to the body for motion between an open position and a closed position, each of the second split base supports having an annular bearing surface of a second diameter corresponding to the second cable and a push surface extending outward from one of the side surfaces of the body;

a first spring for urging the first split base supports towards the closed position, the first split base supports pivoting to the open position when the push surfaces on the first split base supports are pushed towards the side surfaces of the body; and a second spring for urging the second split base supports towards the closed position, the second split base supports pivoting to the open position when the push surfaces on the second split base supports are pushed towards the side surfaces of the body;

the annular bearing surfaces of the first split base supports encircling the first cable in the closed position and providing annular bearing support for an end of the first connector opposite the plunger during compression, the annular bearing surfaces of the first split base supports allowing removal of the first cable when the first split base supports are in the open position; and the annular bearing surfaces of the second split base supports encircling the second cable in the closed position and providing annular bearing support for an end of the second connector opposite the plunger during compression, the annular bearing surfaces of the second split base supports allowing removal of the second cable and insertion of the first cable and first connector when the second split base supports are in the open position.

13. The compression assembly tool according to claim 12 wherein at least one of the first split base supports has a stop surface for contacting the body and at least one of the second split base supports also has a stop surface for contacting the body, the stop surfaces holding the annular bearing surfaces on the first and second split base supports in alignment with the plunger when the split base supports are in the closed position.

14. The compression assembly tool according to claim 12 wherein the first and second split base supports are pivotally attached to the body via a common pivot.

15. The compression assembly tool according to claim 12 wherein the plunger includes a plunger tip having threads engaged in the plunger, the plunger tip being longitudinally adjustable by rotation relative to the plunger.

16. The compression assembly tool according to claim 15 wherein the plunger includes a locking screw, the locking screw being threadedly engaged into the plunger transversely to the plunger tip.

17. The compression assembly tool according to claim 16 wherein the plunger includes an enlarged plunger head for restricting retracted motion of the plunger and the locking screw is threadedly engaged into the enlarged plunger head.

18. A compression assembly tool for attaching first and second connectors of different sizes to the ends of corresponding first and second different cables, the compression assembly tool comprising:

a body having an "O" frame defining a compression region for receiving the end of the cable and the connector;

a lever handle pivotally attached to the body;

a plunger mounted for longitudinal sliding motion relative to the body, the plunger being driven by the lever handle between an extended position to axially compress the connectors and a retracted position to allow the connectors to be removed from the compression region;

a first pair of split base supports located a first distance from the plunger when the plunger is in the extended position, the first split base supports being pivotally attached to the body for motion between an open position and a closed position, each of the first split base supports having an annular bearing surface of a first diameter encircling the first cable when the first pair of split base supports are in the closed position and providing annular bearing support for an end of the first connector opposite the plunger during compression, the annular bearing surfaces on the first pair of split base supports releasing the cable when the first pair of split base supports are in the open position; and a second pair of split base supports located a second distance from the plunger when the plunger is in the extended position, the second distance being greater than the first distance, the second split base supports being pivotally attached to the body for motion between an open position and a closed position, each of the second split base supports having an annular bearing surface of a second diameter encircling the second cable when the second pair of split base supports are in the closed position and providing annular bearing support for an end of the second connector opposite the plunger during compression, the annular bearing surfaces on the second pair of split base supports releasing the cable when the second pair of split base supports are in the open position.

19. The compression assembly tool according to claim 18 further including a link connected between the lever handle and the plunger, the plunger being driven by the lever handle through the link between an extended position to compress the first or second connector and a retracted position to remove the first or second connector from the compression region.

* * * * *

UNITED STATES PATENT AND TRADEMARK OFFICE

CERTIFICATE OF CORRECTION

PATENT NO. : 6,820,326 B1
DATED : November 23, 2004
INVENTOR(S) : Tarpill et al.

It is certified that error appears in the above-identified patent and that said Letters Patent is hereby corrected as shown below:

Column 6,
Line 31, delete "self-enter" and substitute therefore -- self-center --

Signed and Sealed this

Fifth Day of April, 2005

JON W. DUDAS
*Director of the United States Patent and Trademark Office*